US009435066B2

(12) United States Patent
Lee et al.

(10) Patent No.: US 9,435,066 B2
(45) Date of Patent: Sep. 6, 2016

(54) WATER SUPPLY APPARATUS AND WASHING MACHINE HAVING THE SAME

(75) Inventors: Song Yik Lee, Suwon-si (KR); Dong Il Back, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 813 days.

(21) Appl. No.: 13/591,711

(22) Filed: Aug. 22, 2012

(65) Prior Publication Data

US 2013/0047678 A1 Feb. 28, 2013

(30) Foreign Application Priority Data

Aug. 26, 2011 (KR) ..... 10-2011-0086079

(51) Int. Cl.
*D06F 39/02* (2006.01)

(52) U.S. Cl.
CPC ..... *D06F 39/028* (2013.01)

(58) Field of Classification Search
CPC ..... D06F 39/028
See application file for complete search history.

(56) References Cited

U.S. PATENT DOCUMENTS

2005/0188729 A1 9/2005 Zsambeki et al.

FOREIGN PATENT DOCUMENTS

| | | |
|---|---|---|
| EP | 0 504 545 | 1/1992 |
| EP | 1 541 740 | 12/2003 |
| EP | 1 568 815 | 2/2004 |
| GB | 2 104 109 | 7/1982 |
| GB | 2 271 783 | 4/1994 |

OTHER PUBLICATIONS

European Search Report issued Oct. 29, 2013 in corresponding European Application No. 12 18 1030.

*Primary Examiner* — Jason Ko
(74) *Attorney, Agent, or Firm* — Staas & Halsey LLP

(57) ABSTRACT

Disclosed is a water supply apparatus for washing machines having a simplified structure. The water supply apparatus is usable in a washing machine, which has a drum to accommodate laundry, and a detergent supply apparatus including a dispenser provided with a plurality of channels to supply water to a plurality of detergents to be supplied to the drum, and includes at least one water supply pipe extending from the rear portion of the washing machine to the detergent supply apparatus to supply water to the dispenser, a nozzle provided with one end connected to the at least one water supply pipe and the other end disposed adjacent to entrances of the plurality of channels, and being rotatable to supply water selectively to one of the plurality of channels, a drive unit generating drive force to rotate the nozzle, and a rotation control device to control rotation of the drive unit.

15 Claims, 13 Drawing Sheets

WATER SUPPLY APPARATUS AND WASHING MACHINE HAVING THE SAME

CROSS-REFERENCE TO RELATED APPLICATIONS

This application claims the benefit of Korean Patent Application No. 10-2011-0086079, filed on Aug. 26, 2011 in the Korean Intellectual Property Office, the disclosure of which is incorporated herein by reference.

BACKGROUND

1. Field

Embodiments of the present invention relate to a water supply apparatus for washing machines which supplies water to a detergent supply apparatus.

2. Description of the Related Art

A washing machine is machinery which washes laundry using electric power, and includes a tub to store wash water, a drum rotatably installed within the tub, and a motor to rotate the drum.

When the drum is rotated by the motor under the condition that laundry and wash water are placed within the drum, the laundry is washed due to friction of the laundry with the drum and the wash water.

A detergent supply apparatus of the washing machine serves to uniformly mix wash water supplied to the tub with detergents so as to supply the wash water mixed with the detergents to the tub.

The detergent supply apparatus includes a dispenser having a plurality of channels to supply water to the respective detergents, i.e., a main detergent, a fabric softer, a bleaching agent, etc.

In order to supply water to the respective channels, a solenoid valve needs to be connected to the detergent supply apparatus by a plurality of rubber hoses, the detergent supply apparatus has a complicated structure and a large size. Further, since the solenoid valve is used, resonance noise is generated.

SUMMARY

Therefore, it is an aspect of the present disclosure to provide a water supply apparatus having a simple structure for washing machines which supplies water to a detergent supply apparatus.

Additional aspects will be set forth in part in the description which follows and, in part, will be obvious from the description, or may be learned by practice of the invention.

In accordance with one aspect, a water supply apparatus usable in a washing machine, which has a drum to accommodate laundry and a detergent supply apparatus including a dispenser provided with a plurality of channels to supply water to a plurality of detergents to be supplied to the drum. The washing machine includes at least one water supply pipe extending from the rear portion of the washing machine to the detergent supply apparatus to supply water to the dispenser, a nozzle provided with one end connected to the at least one water supply pipe and the other end disposed adjacent to entrances of the plurality of channels, and being rotatable to supply water selectively to one of the plurality of channels, a drive unit generating drive force to rotate the nozzle, and a rotation control device to control rotation of the drive unit.

The nozzle may include an inlet provided adjacent to the at least one water supply pipe such that water is introduced into the nozzle through the inlet, and an outlet to supply water to one of the plurality of channels.

The nozzle inlet may have an area sufficient to cover one end of the at least one water supply pipe so as to allow water supplied from the at least one water supply pipe to be introduced into the nozzle through the inlet.

The nozzle outlet may have a smaller area than the entrances of the plurality of channels to supply water to one of the plurality of channels.

The nozzle inlet may have a greater area than the outlet.

The nozzle may include nozzle side walls forming both side surfaces of the inlet and the outlet, and the nozzle side walls may be formed in a curved line from the inlet to the outlet.

The drive unit may include a motor.

The drive unit may further include a plurality of gears disposed between the motor and the nozzle to transmit drive force of the motor to the nozzle.

The plurality of gears may include a first gear connected to the nozzle and rotated together with the nozzle, and a second gear connected to the motor and rotated by drive force of the motor.

The nozzle may be rotatably accommodated in the detergent supply apparatus, and the drive unit may be disposed on the upper surface of the detergent supply apparatus.

The rotation control device may include a cam connected to the drive unit to be rotated together with the drive unit and including at least one protruding rib protruding in the centrifugal direction, and a switch disposed to contact the cam and locked with and unlocked from the at least one protruding rib to generate an ON signal and an OFF signal when the cam is rotated.

The rotation control device may include a cam connected to the drive unit to be rotated together with the drive unit and including at least one groove disposed in the radial direction, and a switch disposed to contact the cam and locked with and unlocked from the at least one groove to generate an ON signal and an OFF signal when the cam is rotated.

In accordance with another aspect, a water supply apparatus usable in a washing machine, which has a drum to accommodate laundry and a detergent supply apparatus to supply detergents to wash water supplied to the drum, includes at least one water supply pipe extending from the rear portion of the washing machine to the detergent supply apparatus to supply water to the detergent supply apparatus, and a nozzle provided with one end connected to the at least one water supply pipe and the other end disposed to supply water to the detergent supply apparatus, and being rotatable to supply water in a designated direction within the detergent supply apparatus.

The detergent supply apparatus may include a dispenser provided with a plurality of channels to respectively supply water to a plurality of detergents, and the nozzle is rotatable to respectively supply water to the plurality of channels.

The detergent supply apparatus may further include a detergent case forming the external appearance of the detergent supply apparatus and accommodating the dispenser, and the nozzle may be rotatably fixed within the detergent case.

The water supply apparatus may further include a drive unit connected to the nozzle to rotate the nozzle.

The water supply apparatus may further include a rotation control device to control rotation of the drive unit to stop the nozzle in a designated direction to supply water.

In accordance with another aspect, a washing machine includes a cabinet, a tub disposed within the cabinet to store water, a drum disposed within the tub to accommodate laundry, a detergent supply apparatus including a plurality of detergent containers to accommodate a plurality of detergent containers supplied to the drum and provided above the tub, water supply pipes to transmit water supplied from a water supply source provided at the rear of the cabinet to the detergent supply apparatus, and a nozzle rotated to respectively supply water to the plurality of detergent containers, wherein the nozzle is connected to the water supply pipes and installed within the detergent supply apparatus.

The washing machine may further include a drive unit to rotate the nozzle.

The drive unit may include a motor to generate rotary force and at least one gear to transmit rotary force of the motor to the nozzle.

The drive unit may further include a rotation control device to control rotation of the motor.

In accordance with a further aspect, a washing machine includes a cabinet, a tub disposed within the cabinet to store water, a drum disposed within the tub to accommodate laundry, a detergent supply apparatus including a dispenser provided with a plurality of channels to supply detergents to the drum, a nozzle moving within the detergent supply apparatus to respectively supply water to the plurality of channels, a drive unit to move the nozzle within the detergent supply apparatus, and a control device to control movement of the nozzle.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
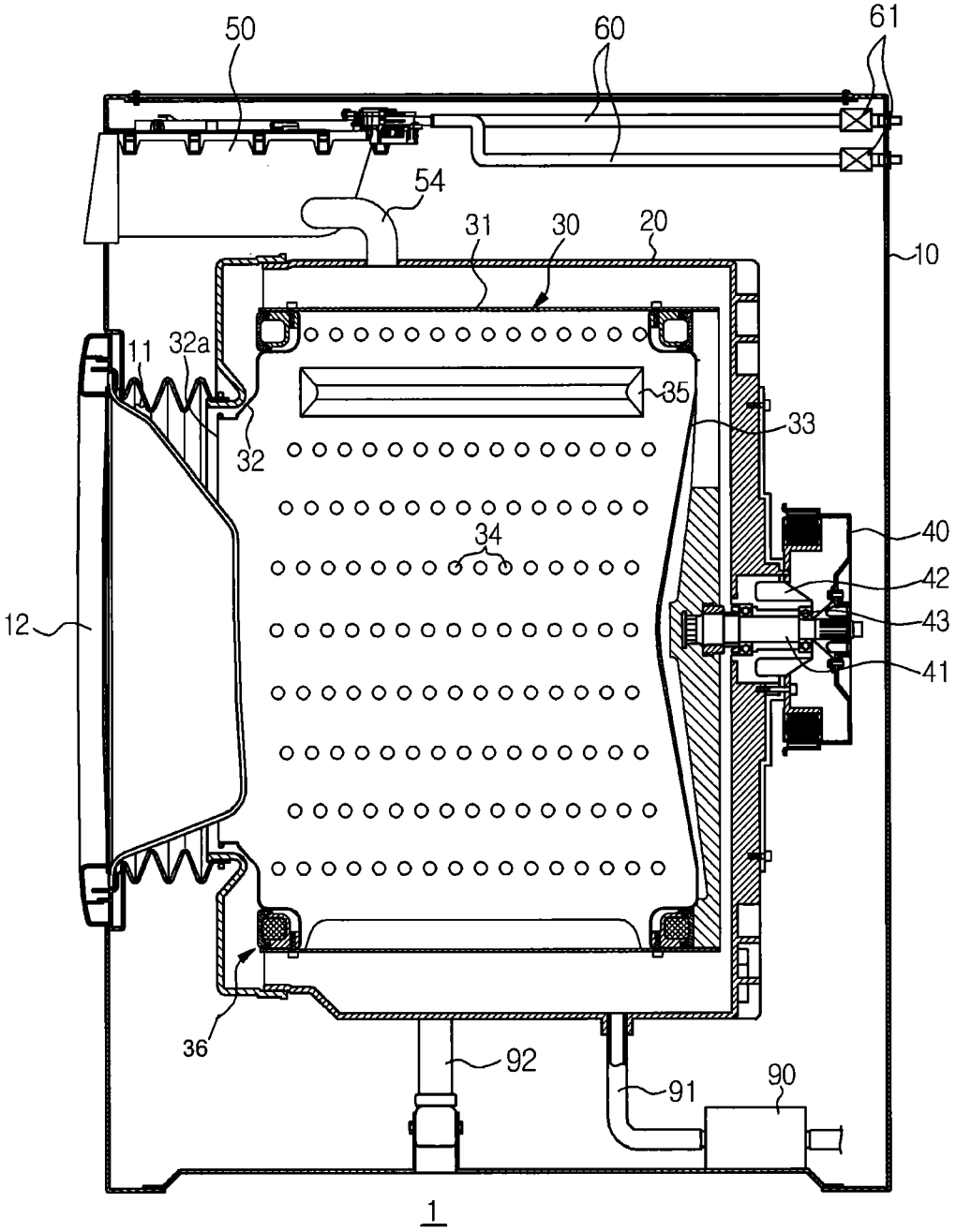
FIG. 1 is a cross-sectional view of a washing machine in accordance with one embodiment of the present invention.

Reference will now be made in detail to the embodiments of the present invention, examples of which are illustrated in the accompanying drawings, wherein like reference numerals refer to like elements throughout.

FIG. 1 is a cross-sectional view of a washing machine in accordance with one embodiment of the present invention.

As shown in FIG. 1, a washing machine 1 in accordance with this embodiment includes a cabinet 10 forming the external appearance of the washing machine 1, a tub 20 disposed within the cabinet 10, a drum 30 rotatably disposed within the tub 20, and a motor 40 to drive the drum 30.

An inlet 11 through which laundry is put into the drum 20 is formed on the front surface of the cabinet 10. The inlet 11 is opened and closed by a door 12 installed on the front surface of the cabinet 10.

The tub 20 is supported by a damper 92. The damper 92 is connected to the inner lower surface of the cabinet 10 and to the outer surface of the tub 20.

A drain pump 90 and a drain pipe 91 to discharge water in the tub 20 to the outside of the cabinet 10 are installed under the tub 20.

The drum 30 includes a cylindrical member 31, a front plate 32 disposed at the front portion of the cylindrical member 31, and a rear plate 33 disposed at the rear portion of the cylindrical member 31. An opening 32*a* through which laundry is put into and taken out of the drum 30 is formed through the front plate 32, and a drive shaft 41 to transmit power of the motor 40 is connected to the rear plate 33.

A plurality of through holes 34 to circulate wash water is provided on the circumference of the drum 30, and the inner space of the drum 30 and the inner space of the tub 20 communicate with each other by the through holes 34.

A plurality of lifters 35 to tumble laundry when the drum 30 is rotated is installed on the inner circumferential surface of the drum 30.

The drive shaft 41 is disposed between the drum 30 and the motor 40. One end of the drive shaft 41 is connected to the rear plate 33 of the drum 30, and the other end of the drive shaft 41 extends to the outside of the rear wall of the tub 20. When the motor 40 drives the drive shaft 41, the drum 30 connected to the drive shaft 41 is rotated about the drive shaft 41.

A bearing housing 42 to rotatably support the drive shaft 41 is installed on the rear wall of the tub 20. The bearing housing 42 may be formed an aluminum alloy, and be inserted into the rear wall of the tub 20 when the tub 20 is produced through injection molding. Bearings 43 to facilitate rotation of the drive shaft 41 are installed between the bearing housing 42 and the drive shaft 41.

During a washing cycle, the motor 40 rotates the drum 30 at a low velocity in a regular direction and in the reverse direction, and thereby tumbling of the laundry within the drum 30 is repeated, thus removing contaminants from the laundry.

During a spin-drying cycle, when the motor 40 rotates the drum at a high velocity in one direction, water is separated from the laundry by centrifugal force applied to the laundry.

When the laundry is not uniformly distributed within the drum 30 and is concentrated into a specific region during rotation of the drum 30 in the spin-drying process, unbalanced load occurs within the drum 30, and thus rotation of the drum 30 becomes instable and vibration and noise occur.

Therefore, the washing machine 1 is provided with balancers 36 to stabilize rotation of the drum 30. Here, a pair of balancers 36 is formed on the front plate 32 and the rear plate 33 of the drum 30.

Water supply pipes 60 to supply wash water to the tub 20 are installed above the tub 20. One end of each of the water supply pipes 60 is connected to an external water supply source (not shown), and the other end of each of the water supply pipes 60 is connected to a detergent supply apparatus 50.

The detergent supply apparatus 50 is connected to the tub 20 through a connection pipe 54. Water supplied through the water supply pipe 60 is supplied to the detergent supply apparatus 52 and is mixed with detergents in the detergent supply apparatus 52, and the water mixed with the detergents is supplied to the inside of the tub 20.

Figure 2:
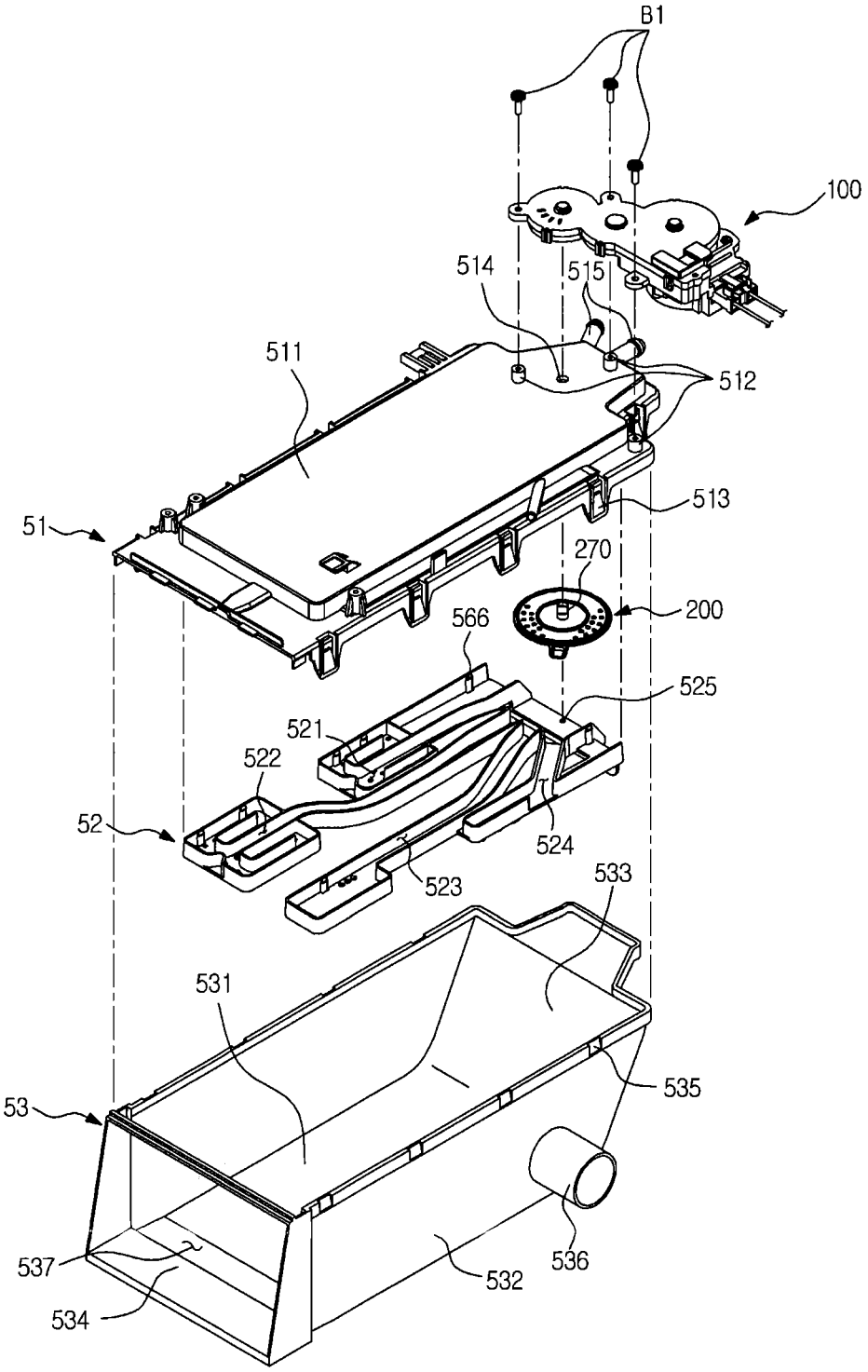
FIG. 2 is an exploded perspective view illustrating respective components of a detergent supply apparatus and a water supply apparatus of the washing machine in accordance with the embodiment of the present invention.
Figure 3:
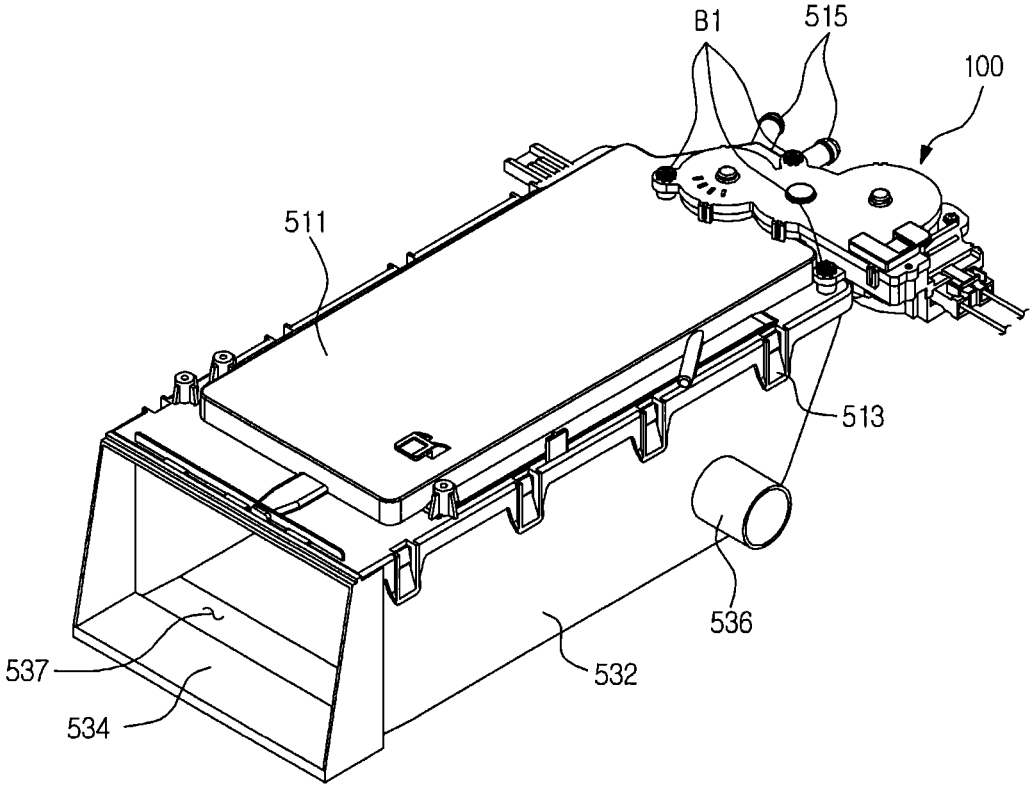
FIG. 3 is a perspective view illustrating connection of the respective components of FIG. 2.

FIG. 2 is an exploded perspective view illustrating respective components of the detergent supply apparatus and a water supply apparatus of the washing machine in accordance with the embodiment of the present invention, and FIG. 3 is a perspective view illustrating connection of the respective components of FIG. 2.

As shown in FIGS. 2 and 3, the detergent supply apparatus 50 includes a detergent case 53 forming the external appearance of the detergent supply apparatus 50, a detergent case cover 51 disposed to cover the upper portion of the detergent case 53, and a dispenser 52 disposed between the detergent case 53 and the detergent case cover 51.

The water supply apparatus includes a nozzle 200 rotatably disposed between the detergent case cover 51 and the dispenser 52, and a drive unit 100 to supply drive force to rotate the nozzle 200.

The detergent case 53 includes a bottom surface 531, side walls 532 protruding upwards from the bottom surface 531 to form both side surfaces of the detergent case 53, and a rear plate 533 bent upwards from the bottom surface 531 in a gentle curved line to form a rear surface of the detergent case 53.

A plurality of first accommodation parts 535 to accommodate first connection parts 531 of the detergent case cover 51, which will be described later, to connect the detergent case cover 51 to the detergent case 53 is formed on the side walls 532. The embodiment illustrated in the drawings describes eight first accommodation parts 535.

A front frame 534 provided with an opening 537 is located at the front surface of the detergent case 53, and is connected to the bottom surface 531 and the side walls 532. Detergent containers (not shown) accommodating detergents are accommodated in the opening 537.

The upper surface of the detergent case 53 is opened.

The detergent case cover 51 covers the opened upper surface of the detergent case 53, thus forming the external appearance of the detergent supply apparatus 50 together with the detergent case 53. Although the embodiment illustrated in the drawings describes the detergent case cover 51 as having a central portion protruding upwards to form a 2-step structure, the detergent case cover 51 may have other multi-step structures.

Three first connection recesses 512 are formed on an upper plate 511 of the detergent case cover 51 so as to connect the drive unit 100 to the upper plate 511. First connection holes 101*a*, 101*b* and 101*c* are formed at positions of the drive unit 100 corresponding to the first connection recesses 512. When bolts B1 pass through the first connection holes 101*a*, 101*b* and 101*c* and are fastened to the first connection recesses 512, the drive unit 100 is connected to the upper plate 511 of the detergent case cove 51. The drive unit 100 will be described later with reference to FIG. 4.

Connection pipes 515 to which the water supply pipes 60 (with reference to FIG. 1) are connected protrude from the rear portion of the detergent case cover 51. FIGS. 2 and 3 illustrate two connection pipes 515 to which a warm water supply pipe and a cold water supply pipe are respectively connected.

The dispenser 52 includes plural channels 521, 522, 523 and 524, and the plural channels 521, 522, 523 and 524 form the external appearance of the dispenser 52. The detergent containers (not shown) accommodate a main detergent, a fabric rinse, a bleaching agent, etc., and in order to separately supply water thereto, the plural channels 521, 522, 523 and 524 are formed.

The dispenser 52 includes second connection parts 566, and is connected to the detergent case cover 51 by fastening the second connection parts 566 to connection recesses (not shown) of the detergent case cover 51.

A second accommodation hole 525 in which one end of a shaft 270 of the nozzle 200 is accommodated is formed at the rear portion of the dispenser 52. Further, a first accommodation hole 514 in which the other end of the shaft 270 of the nozzle 200 is accommodated is formed at a portion of the upper plate 511 of the detergent case cover 51 corresponding to the second accommodation hole 525.

The nozzle 200 is disposed between the dispenser 52 and the detergent case cover 51 under the condition that one end of the shaft 270 is accommodated in the second accommodation hole 525 and the other end of the shaft 270 is accommodated in the first accommodation hole 514. When the dispenser 52 is connected to the detergent case cover 51, the nozzle 200 is located between the dispenser 52 and the detergent case cover 51 so as to be rotated about the shaft 270.

First connection parts 513 are formed at positions of the side surfaces of the detergent case cover 51 corresponding to the first accommodation parts 535. FIGS. 2 and 3 illustrate eight first connection parts 513 corresponding to the number of the first accommodation parts 535. The first connection parts 513 protrude the side surfaces of the detergent case cover 51 in the direction towards the detergent case 53, and the ends of the first connection parts 513 protrude inwards to be fixed to the first accommodation parts 535.

Therefore, when the protruding ends of the first connection parts 513 are accommodated in the first accommodation parts 535, the detergent case cover 51 is connected to the detergent case 53.

Figure 4:
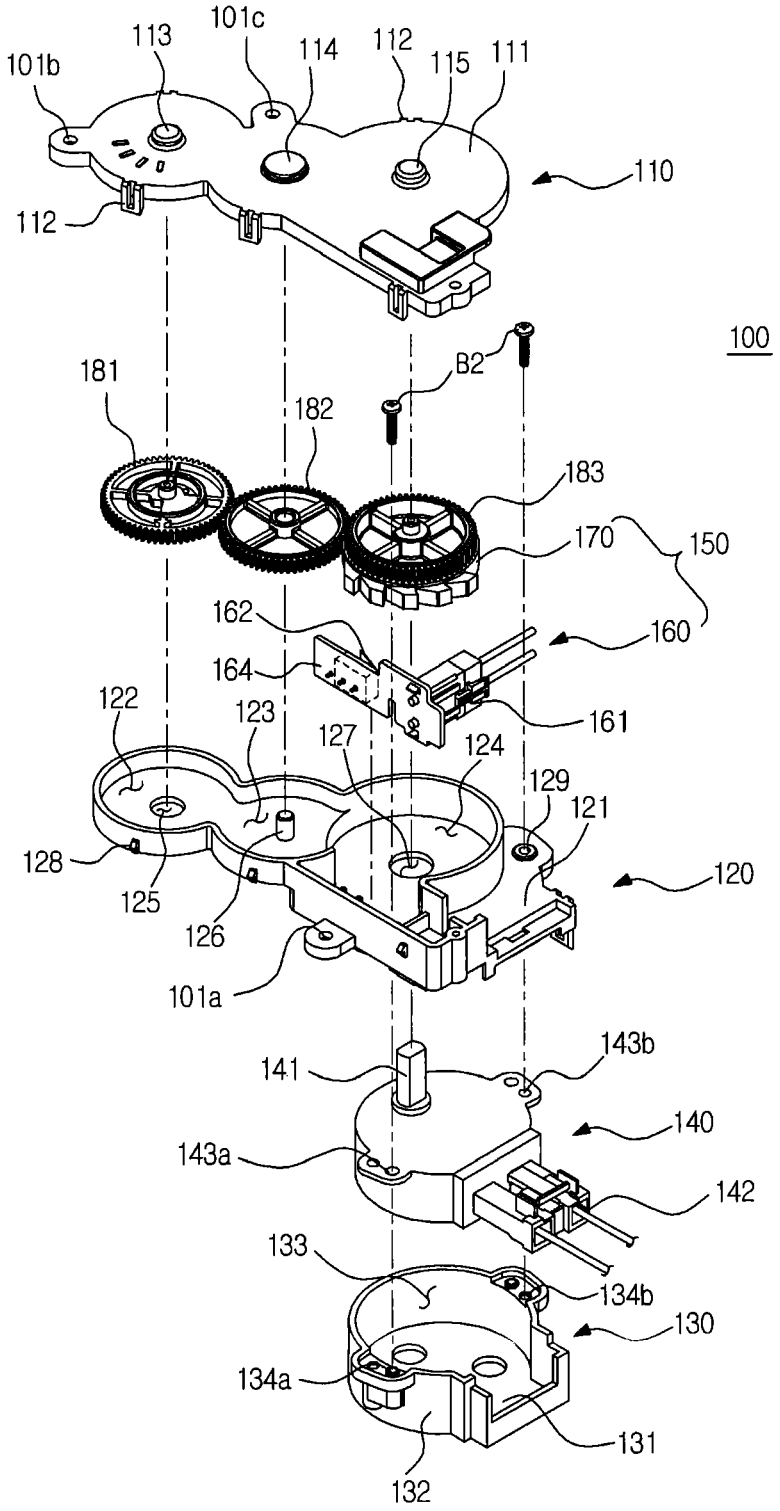
FIG. 4 is an exploded perspective view illustrating respective components of a drive unit of FIG. 2.

FIG. 4 is an exploded perspective view illustrating respective components of the drive unit of FIG. 2.

As shown in FIG. 4, the drive unit 100 includes a motor 140 to generate drive force, a motor case 130 to accommodate the motor 140, plural gears 181, 182 and 183 to transmit drive force of the motor to the nozzle 20 (with reference to FIG. 2), a gear case 120 to accommodate the plural gears 181, 182 and 183, a gear cover 110 connected to the gear case 120 to cover the plural gears 181, 182 and 183, and a rotation control device 150 to control rotation of the motor 140.

The rotation control device 150 includes a cam 170, and a printed circuit board (PCB) assembly 160 sensing a degree of rotation of the cam 170 to control the motor 140. The rotation control device 150 will be described later with reference to FIG. 6.

The gear case 120 includes a case main body 121 forming the external appearance of the gear case 120, gear accommodation parts 122, 123 and 124 protruding upwards from the case main body 121 to accommodate the plural gears 181, 182 and 183, and a PCB accommodation part 165 protruding upwards from the case main body 121 to accommodate the PCB assembly 150.

The plural gears 181, 183 and 183 include a first gear 181, a second gear 183 and a third gear 182. Although the embodiment illustrated in the drawings describes three gears, more or less than three gears may be provided. However, three or four gears may be provided in consideration of the sizes of the gears and the size of the water supply apparatus.

The first gear 181 includes its own shaft and is accommodated in the first gear accommodation part 122 of the gear case 120. The first gear accommodation part 122 is provided with a first shaft accommodation hole 125 to accommodate the shaft of the first gear 181. The first gear 181 is connected to the nozzle 200 (with reference to FIG. 2) through the shaft, thus being rotated together with the nozzle 200.

The second gear 183 includes its own shaft and is accommodated in the second gear accommodation part 124 of the gear case 120. The second gear accommodation part 124 is provided with a second shaft accommodation hole 127 to accommodate the shaft of the second gear 183. The second gear 183 is connected to the cam 170 through the shaft, thus being rotated together with the cam 170. Further, the second gear 183 and the cam 170 are connected to a shaft 141 of the motor 140 located thereunder, thus being rotated by drive force of the motor 140.

The third gear 182 includes a hollow formed at the center of rotation thereof and is accommodated in the third gear accommodation part 123 of the gear case 120. The third gear accommodation part 123 is provided with a protruding rotation shaft 126 which is inserted into the hollow of the third gear 182. When the rotation shaft 126 is inserted into the hollow of the third gear 182, the third gear 182 is accommodated in the third gear accommodation part 123. The third gear 182 is disposed between the first gear 181 and the second gear 183 so as to be engaged with the first gear 181 and the second gear 183. Therefore, the third gear 182 receives drive force of the motor 140 through the second gear 183, and transmits the drive force to the first gear 181 and the nozzle 200 (with reference to FIG. 2).

A first shaft accommodation recess 113 protruding upwards to accommodate the shaft of the first gear 181 and a second shaft accommodation recess 115 protruding upwards to accommodate the shaft of the second gear 183 are formed on the lower surface of the gear cover 110. Further, a third shaft accommodation recess 114 protruding upwards to accommodate the rotation shaft 126 inserted into the hollow of the third gear 182 is formed on the lower surface of the gear cover 110.

Connection protrusions 128 connected to the gear cover 110 are formed on the side surface of the gear case 120. Second fastening parts 112 protruding downwards to accommodate the connection protrusions 128 are formed on the side surface of the gear cover 110. When the connection protrusions 128 are fastened to the second fastening parts 112, the gear cover 110 is connected to the gear case 120.

The motor case 130 and the motor 140 are connected under the gear case 120.

The motor case 130 includes a bottom surface 131, and a side surface 132 having the same shape of the motor 140 and protruding upwards from the bottom surface 131. A load part 133 on which the motor 140 is loaded is formed at the inside of the side surface 132.

The motor 140 includes a power supply unit 142 connected to one side of the motor 140 to supply power to the motor 140, the shaft 141 passing through the second shaft accommodation hole 127 and connected to the second gear 183 and the cam 170 to transmit drive force of the motor 140 to the second gear 183 and the cam 170, and third fastening holes 143*a* and 143*b* to connect the motor 140 to the gear case 120 and the motor case 130.

Bolts B2 pass through second connection holes 129 (here, only one second connection hole is illustrated) formed at one side of the gear case 120 and the third fastening holes 143*a* and 143*b* formed on the motor 140 and are fastened to second connection recesses 134*a* and 134*b* formed at one side of the motor case 130, thereby connecting the gear case 120, the motor 140 and the motor case 130.

In order to connect the drive unit 100 to the detergent case cover 51, as described above, the first fastening holes 101*a*, 101*b* and 101*c* are formed on the drive unit 100. The embodiment illustrated in the drawings describes three first fastening holes 101*a*, 101*b* and 101*c*, two fastening holes 101*b* and 101*c* are formed at one side of the gear cover 110, and one fastening hole 101*a* is formed on the gear case 120.

Figure 5:
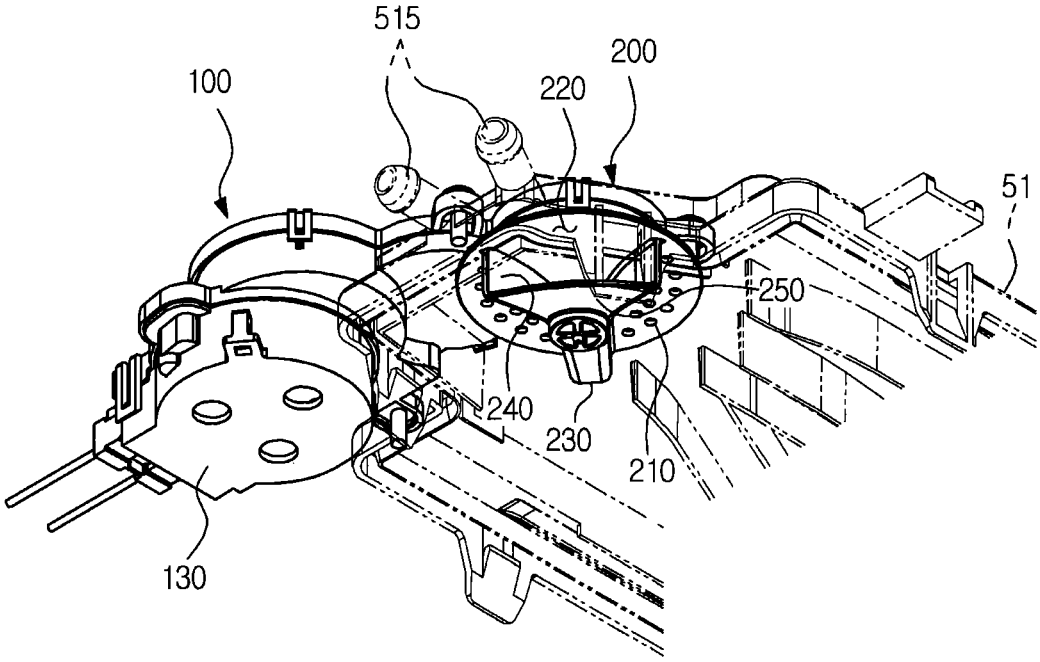
FIG. 5 is a perspective view illustrating the water supply apparatus of the washing machine in accordance with the embodiment of the present invention.

FIG. 5 is a perspective view illustrating the water supply apparatus of the washing machine in accordance with the embodiment of the present invention.

A description of the above-described drive unit 100 and gear cover 110 will be omitted.

As shown in FIG. 5, the nozzle 200 includes a nozzle main body 210 connected to the cam 170 (with reference to FIG. 4) to rotate the nozzle 200, nozzle side walls 240 protruding downwards from the nozzle main body 210 to form both side surfaces of the nozzle 200, and a nozzle bottom surface 250 connecting both nozzle side walls 240. A hollow in which water flows is formed within a space formed by the nozzle side walls 240 and the nozzle bottom surface 250. An inlet 220 through which water supplied from the water supply pipe 60 (with reference to FIG. 1) is introduced into the nozzle 200 is formed at one side of the hollow, and an outlet 230 through which water is discharged to the dispenser 52 is formed at the other side of the hollow.

Figure 6A:
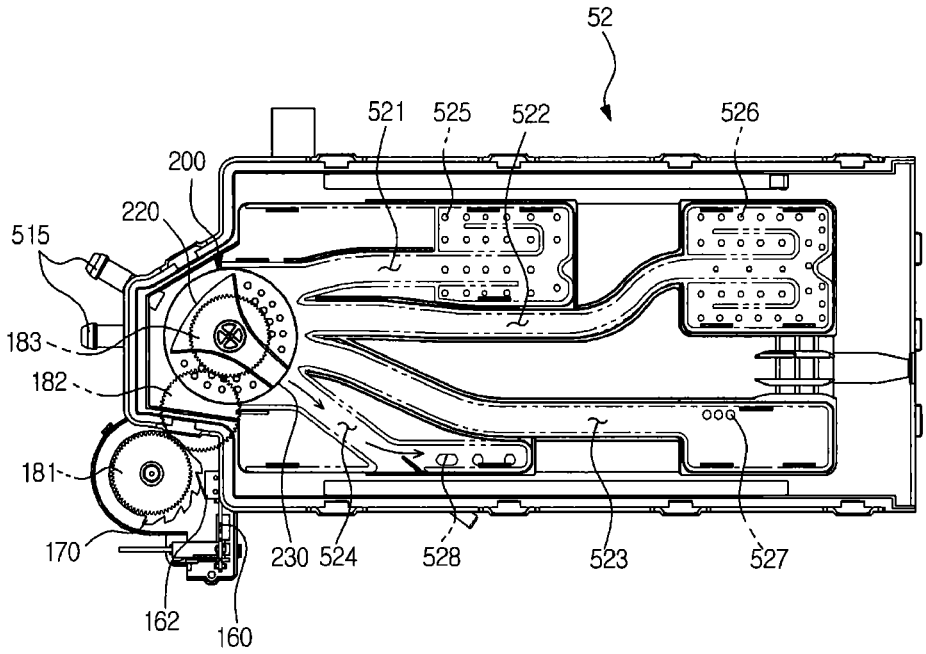
FIGS. 6A and 6B are views illustrating operation of the water supply apparatus of the washing machine.
Figure 6B:
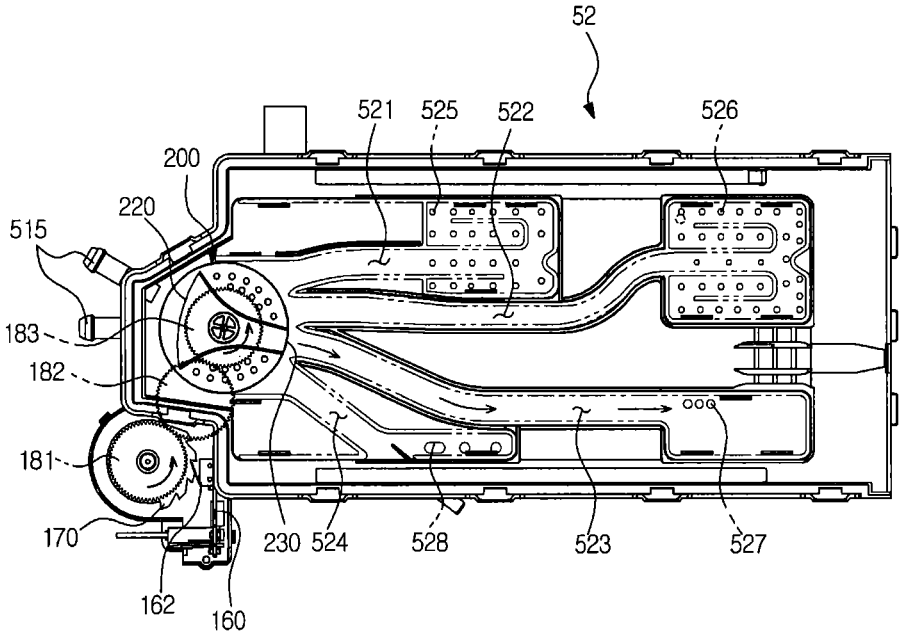

FIGS. 6A and 6B are views illustrating operation of the water supply apparatus of the washing machine. Particularly, in order to describe rotating states of the nozzle 200, FIGS. 6A and 6B illustrate the detergent case cover 51 to which the dispenser 52 and the nozzle 200 are connected, as seen from the bottom.

FIG. 6A illustrates the nozzle 200 which supplies water towards the first channel 524, and FIG. 6B illustrates the nozzle 200 which supplies water towards the second channel 523.

As shown in FIGS. 6A and 6B, the cam 170 and the first gear 181 connected to the motor 140 (with reference to FIG. 4) are rotated in the counterclockwise direction. Although FIGS. 6A and 6B illustrate the cam 170 and the first gear 181 as being rotated in the counterclockwise direction, the cam 170 and the first gear 181 are rotated in the clockwise direction, as seen from the top. Further, when arrangement and shapes of the cam 170 and a switch 162 are changed, the cam 170 and the first gear 181 may be rotated in the clockwise direction.

When the cam 170 and the first gear 181 are rotated in the counterclockwise direction, the third gear 182 engaged with the first gear 181 is rotated in the clockwise direction, and the second gear 183 engaged with the third gear 182 is rotated in the counterclockwise direction.

The nozzle 200 first supplies water towards the first channel 524, as shown in FIG. 6A, and when the nozzle 200 is rotated, the nozzle 200 supplies water towards the second channel 523, as shown in FIG. 6B. Then, the nozzle 200 is rotated in such a manner, thereby supplying water towards the third channel 522 and the fourth channel 521.

Water supplied to the respective channels 521, 522, 523 and 524 is discharged to the detergent case 53 through discharge holes 525, 526, 527 and 528 provided at one end of each of the channels 521, 522, 523 and 524.

Although the nozzle 200 is rotated, both connection pipes 515 may supply water towards the wide inlet 220. As described above, the warm water supply pipe is connected to one of the two connection pipes 515, and the cold water supply pipe is connected to the other of the two connection pipes 515.

Therefore, while the conventional water supply apparatus requires many connection pipes to supply cold water and warm water to all of channels of a dispenser, the water supply apparatus 50 in accordance with the present invention may supply cold water and warm water to all of the plural channels 521, 522, 523 and 524 through a simple structure.

Figure 7A:
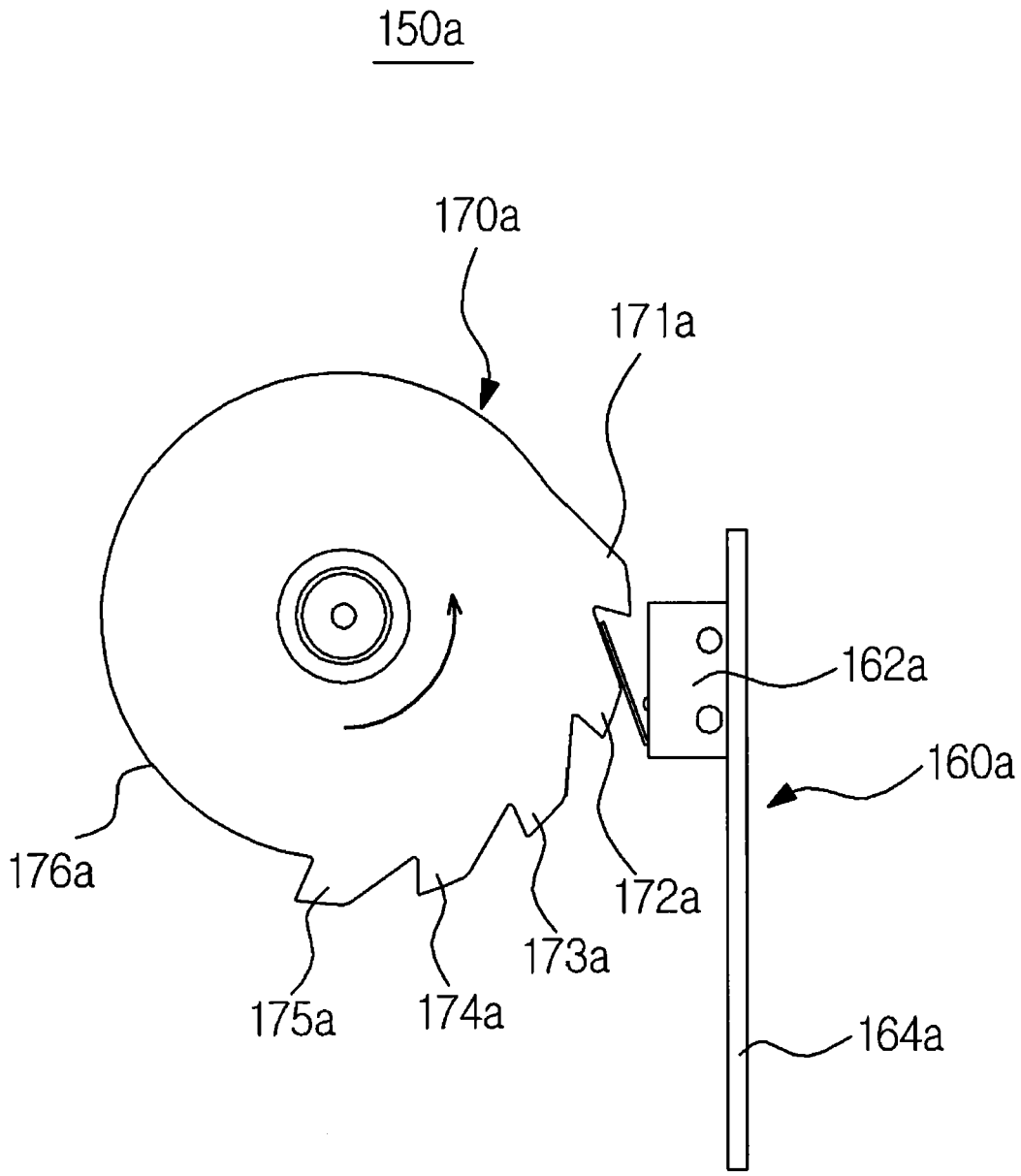
FIG. 7A is a view illustrating a rotation control device of a washing machine in accordance with one embodiment of the present invention.
Figure 7B:
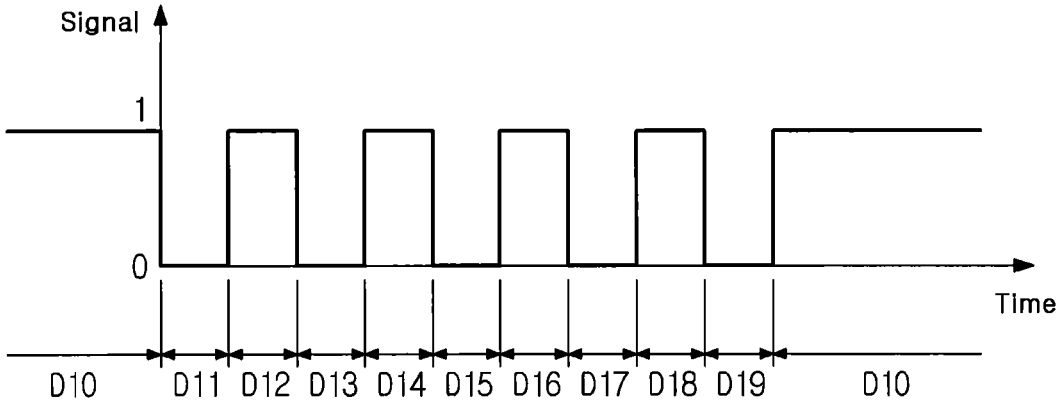
FIG. 7B illustrates a graph representing signals transmitted by a switch of the rotation control device of FIG. 7A.

FIG. 7A is a view illustrating a rotation control device of a washing machine in accordance with one embodiment of the present invention, and FIG. 7B illustrates a graph representing signals transmitted by a switch of the rotation control device of FIG. 7A.

In order to coincide with the rotating direction of the nozzle in FIGS. 6A and 6B, FIG. 7A illustrates the cam, as seen from the bottom.

As shown in FIG. 7A, a rotation control device 150*a* includes a cam 170*a* and a PCB assembly 160*a*. The PCB assembly 160*a* includes a PCB 164*a*, and a switch 162*a* mounted on one surface of the PCB 164*a* to contact the cam 170*a*.

The cam 170*a* includes a disc-shaped cam main body 176*a*, and five protruding ribs 171*a*, 172*a*, 173*a*, 174*a* and 175*a*.

The nozzle 200 (with reference to FIG. 2) is disposed at the lower end of the cam 170*a*, and is rotated together with the cam 170*a*.

The cam 170*a* and the nozzle 200 are disposed such that when the switch 162*a* is located between the first protruding rib 171*a* and the second protruding rib 172*a*, the outlet 230 of the nozzle 200 faces the first channel 524, when the switch 162*a* is located between the second protruding rib 172*a* and the third protruding rib 173*a*, the outlet 230 of the nozzle 200 faces the second channel 523, when the switch 162*a* is located between the third protruding rib 173*a* and the fourth protruding rib 174*a*, the outlet 230 of the nozzle 200 faces the third channel 522, and when the switch 162*a* is located between the fourth protruding rib 174*a* and the fifth protruding rib 175*a*, the outlet 230 of the nozzle 200 faces the fourth channel 521.

The switch 162*a* contacts the cam 170*a*. When the cam 170*a* is rotated in the counterclockwise direction and the switch 162*a* is pressed by the protruding ribs 171*a*, 172*a*, 173*a*, 174*a* and 175*a*, the switch 162*a* generates a signal '0', and when the switch 162*a* is located between the protruding ribs 171*a*, 172*a*, 173*a*, 174*a* and 175*a*, the switch 162*a* generates a signal '1'.

As shown in FIG. 7B, a section D11 in which the signal '1' is continuously generated and then the signal '0' is initially generated corresponds to a position where the first protruding rib 171*a* presses the switch 162*a* in such a manner, a position where the second protruding rib 172*a* is adjacent to the switch 162*a* corresponds to a section D13 in which the signal '0' is secondarily generated, a position where the third protruding rib 173*a* is adjacent to the switch 162*a* corresponds to a section D15 in which the signal '0' is thirdly generated, a position where the fourth protruding rib 174*a* is adjacent to the switch 162*a* corresponds to a section D17 in which the signal '0' is fourthly generated, and a position where the fifth protruding rib 175*a* is adjacent to the switch 162*a* corresponds to a section D19 in which the signal '0' is fifthly generated.

When the cam main body 176*a* is adjacent to the switch 162*a*, the signal '1' is generated for a long time, and thus a position where the cam main body 176*a* is adjacent to the switch 162*a* corresponds to a section D10.

As described above, in a stopped state of the cam 170*a*, the resolution value of a degree of rotation of the cam 170*a* is not measured. The signal '1' is generated for a long time during rotation of the cam 170*a* and then the signal '0' is initially generated (the section D11). Thereafter, a point of time when the rotating cam 170*a* faces one direction may be measured by judging the number of times that the signal '1' is generated.

Accordingly, prior to start of operation, the cam 170*a* needs to be rotated to the initial position, i.e., the position where the first protruding rib 171*a* presses the switch 162*a*. That is, the stopped cam 170*a* is rotated until the signal '1' is generated for a long time and then the signal '0' is initially generated.

For example, in order to supply water to the third channel 522 (with reference to FIG. 6A), the cam 170*a* is disposed so that the switch 162*a* contacts the region between the third protruding rib 173*a* and the fourth protruding rib 174*a*. First, the cam 170*a* is rotated, and thus the signal generated by the switch 162*a* is sensed. When the signal '1' is generated for a long time (the section D10) and then the signal '0' is initially generated, it is judged that the cam 170*a* is located such that the first protruding rib 171*a* corresponding to the initial position is adjacent to the switch 162*a*. Rotation of the cam 170*a* is stopped at a point of time when the signal '1' is thirdly sensed starting from rotation of the cam 170*a* at the initial position (the section D16). Then, the cam 170*a* is located such that the switch 162*a* contacts the region between the third protruding rib 173*a* and the fourth protruding rib 174*a*, and the outlet 230 (with reference to FIG. 6A) of the nozzle 200 (with reference to FIG. 6A) faces the third channel 522 (with reference to FIG. 6A). Therefore, when water is supplied from the water supply pipe 60, the water is supplied to the third channel 522 through the nozzle 200.

Figure 8A:
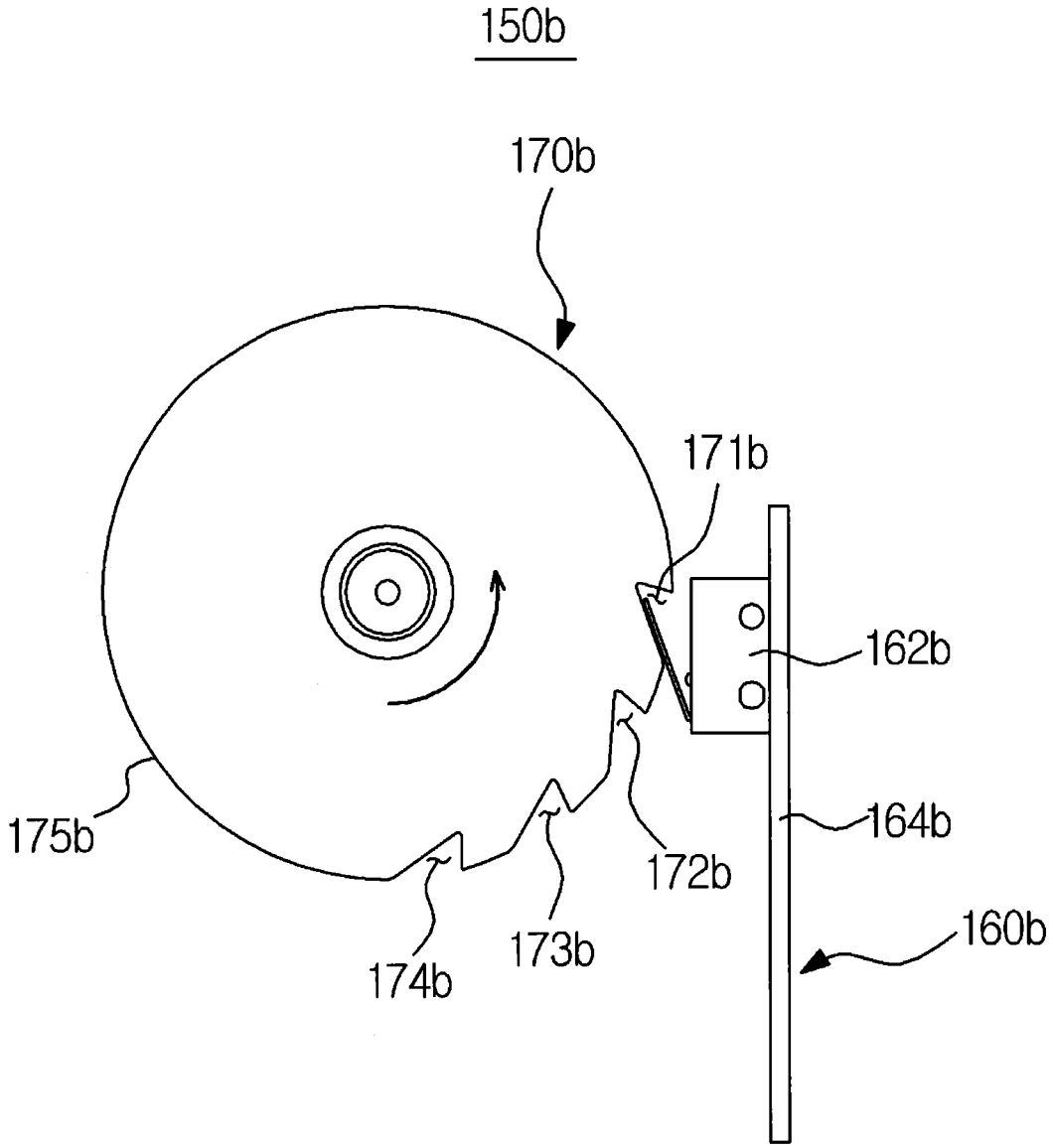
FIG. 8A is a view illustrating a rotation control device of a washing machine in accordance with another embodiment of the present invention.
Figure 8B:
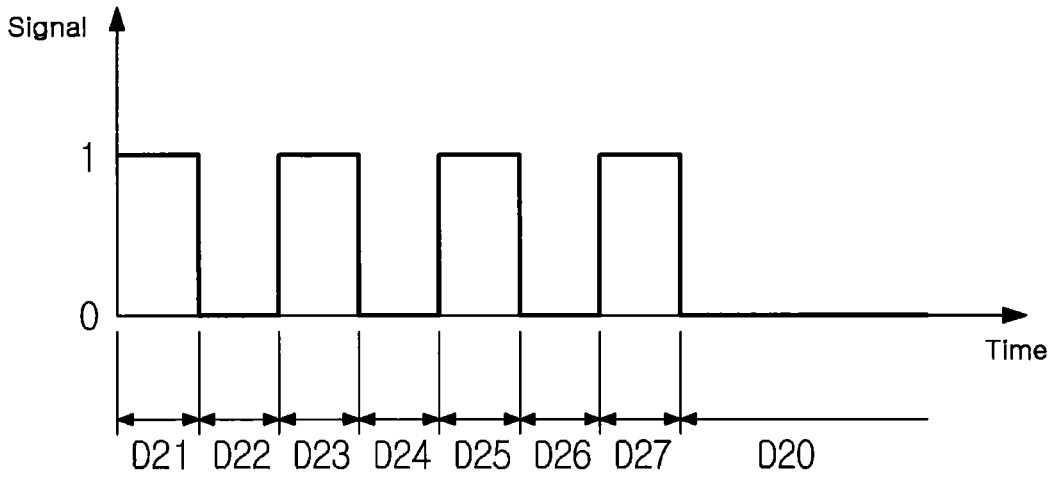
FIG. 8B illustrates a graph representing signals transmitted by a switch of the rotation control device of FIG. 8A.

FIG. 8A is a view illustrating a rotation control device of a washing machine in accordance with another embodiment of the present invention, and FIG. 8B illustrates a graph representing signals transmitted by a switch of the rotation control device of FIG. 8A.

In order to coincide with the rotating direction of the nozzle in FIGS. 6A and 6B, FIG. 8A illustrates the cam, as seen from the bottom.

As shown in FIG. 8A, a rotation control device 150*b* includes a cam 170*b* and a PCB assembly 160*b*. The PCB assembly 160*b* includes a PCB 164*b*, and a switch 162*b*.

The cam 170*b* is the same as the cam 170*a* of FIG. 7A in that the cam 170*b* includes a disc-shaped cam main body 175*b*, but includes four grooves 171*b*, 172*b*, 173*b* and 174*b* other than protruding ribs.

The cam 170*b* and the nozzle 200 are disposed such that when the switch 162*b* contacts the first groove 171*b*, the outlet 230 of the nozzle 200 (with reference to FIG. 2) faces the first channel 524, when the switch 162*b* contacts the second groove 172*b*, the outlet 230 faces the second channel 523, when the switch 162*b* contacts the third groove 173*b*, the outlet 230 faces the third channel 522, and when the switch 162*b* contacts the fourth groove 174*b*, the outlet 230 faces the fourth channel 521.

When the cam 170*b* is rotated in the counterclockwise direction and the switch 162*b* contacts the grooves 171*b*, 172*b*, 173*b* and 174*b*, the switch 162*b* generates a signal '1', and when the cam 170*a* is located at other positions, the switch 162*b* generates a signal '0'.

As shown in FIG. 8B, a section D21 in which the signal '1' is initially generated corresponds to a position where the switch 162*b* contacts the first groove 171*b*. In such a manner, a position where the switch 162*b* contacts the second groove 172*b* corresponds to a section D23 in which the signal '1' is secondarily generated, a position where the switch 162*b* contacts the third groove 173*b* corresponds to a section D25 in which the signal '1' is thirdly generated, and a position where the switch 162*b* contacts the fourth groove 174*b* corresponds to a section D27 in which the signal '1' is fourthly generated. A position where the switch 162*b* contacts the cam main body 175*b* corresponds to a section D20 in which the signal '0' is generated for a long time, and when the switch 162*b* passes by the section D20, the switch 162*b* again enters the section D21.

In the same manner as the embodiment of FIGS. 7A and 7B, in this embodiment, only relative positions of other positions with respect to the initial position (the section D21) may be detected. Accordingly, prior to start of operation, the cam 170*b* needs to be rotated to the initial position (the section D21).

Such rotation is the same as that in the embodiment of FIGS. 7A and 7B, and a detailed description thereof will thus be omitted.

Figure 9A:
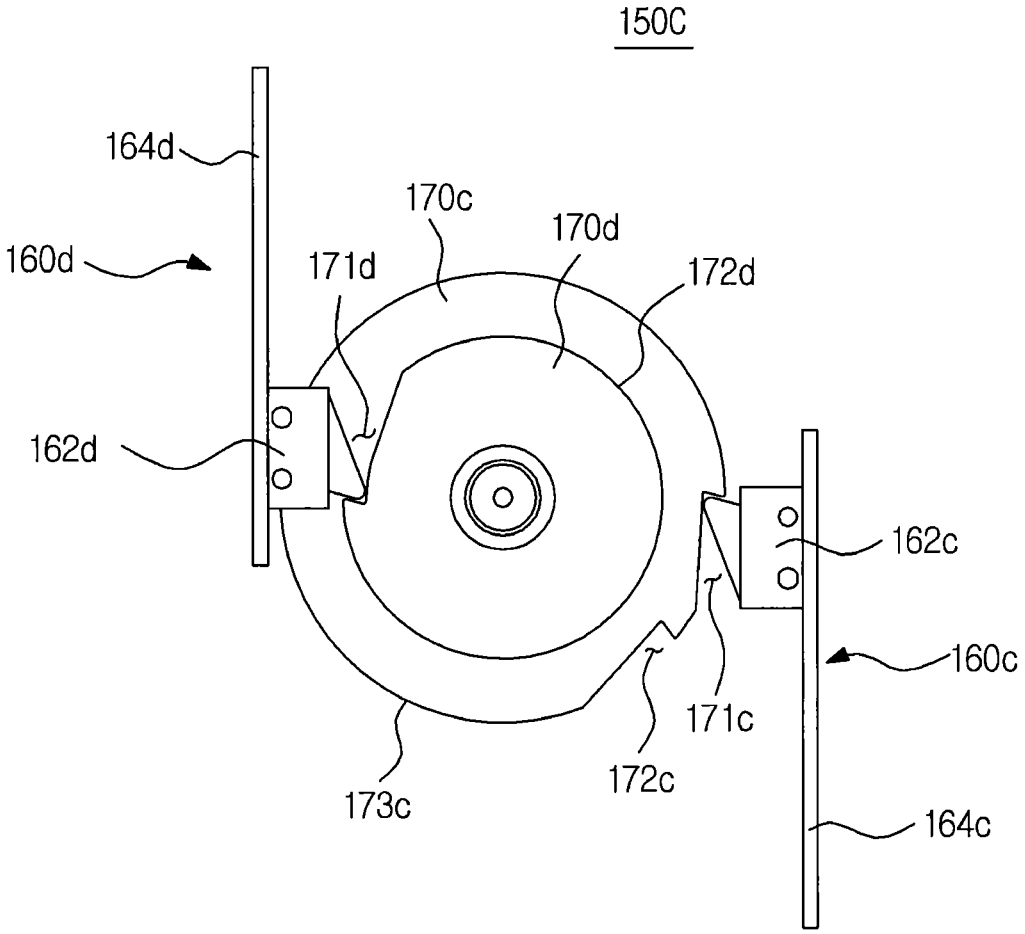
FIG. 9A is a view illustrating a rotation control device of a washing machine in accordance with a further embodiment of the present invention.
Figure 9B:
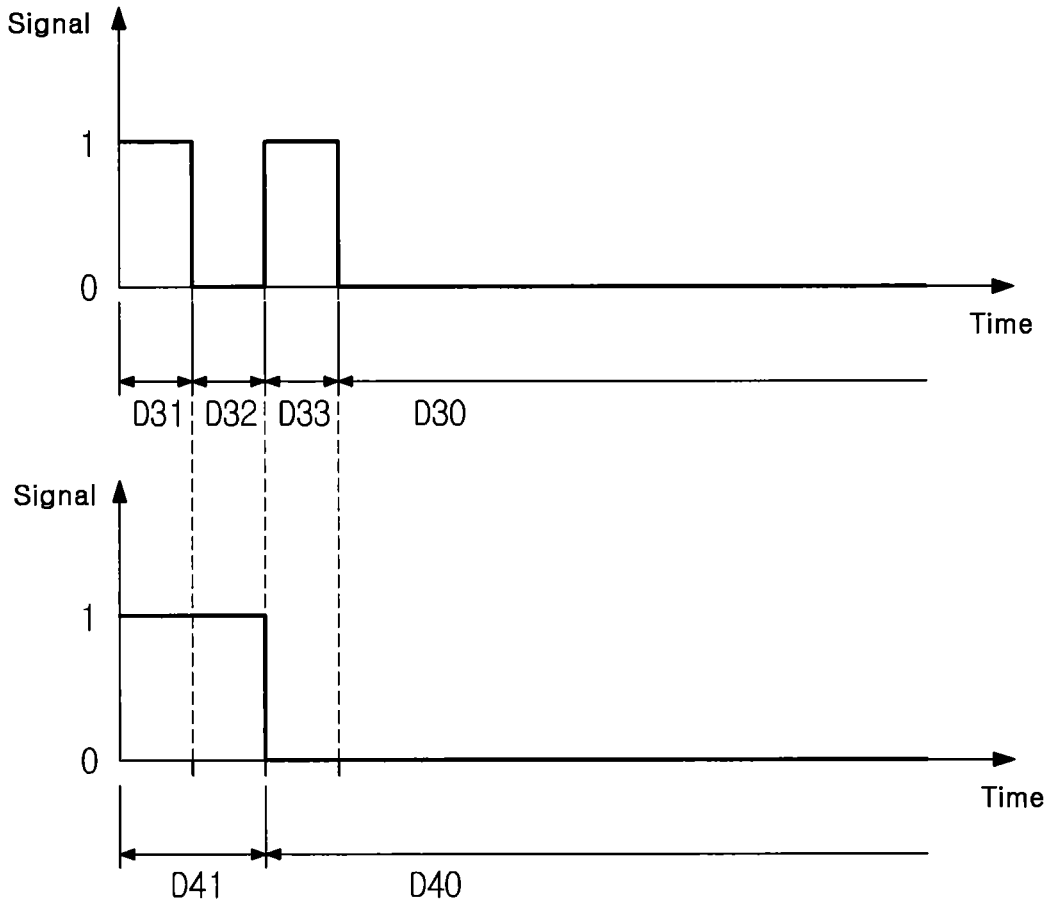
FIG. 9B illustrates graphs representing signals transmitted by switches of the rotation control device of FIG. 9A.

FIG. 9A is a view illustrating a rotation control device of a washing machine in accordance with a further embodiment of the present invention, and FIG. 9B illustrates graphs representing signals transmitted by switches of the rotation control device of FIG. 9A.

In order to coincide with the rotating direction of the nozzle in FIGS. 6A and 6B, FIG. 9A illustrates the cam, as seen from the bottom.

As shown in FIG. 9A, a rotation control device 150*c* includes a first cam 170*c*, a second cam 170*d*, and two PCB assemblies 160*c* and 160*d* corresponding to the respective cams 170*c* and 170*d*.

The first PCB assembly 160*c* includes a PCB 164*c*, and a first switch 162*c* mounted on one surface of the PCB 164*c* to contact the first cam 170*c*.

The second PCB assembly 160*d* includes a PCB 164*d*, and a second switch 162*d* mounted on one surface of the PCB 164*d* to contact the second cam 170*d*.

The first cam 170*c* includes a disc-shaped first cam main body 173*c*, and a first groove 171*c* and a second groove 172*c* formed on the first cam main body 173*c*.

The second cam 170*d* includes a disc-shaped second cam main body 173*d*, and a third groove 171*d* formed on the second cam main body 173*d*.

The first cam 170*c* and the second cam 170*d* are connected to each other and are rotated together.

In FIG. 9B, the upper graph illustrates signals generated by the first switch 170*c*, and the lower graph illustrates signals generated by the second switch 170*d*.

When the cams 170*d* and 170*d* are rotated in the counterclockwise direction and the switches 162*c* and 162*d* contact the grooves 171*c*, 172*c* and 171*d*, the switches 162*c* and 162*d* generate a signal '1', and when the cams 170*d* and 170*d* are located at other positions, the switches 162*c* and 162*d* generate a signal '0'.

If the first cam 170*c* and the second cam 170*d* are disposed, as shown in FIG. 9A, four positions may be defined.

A first position corresponds to the case in which the first switch 162*c* contacts the first groove 171*c* and the second switch 162*d* contacts the third groove 171*d*, as shown in FIG. 9A. At the first position, both the first switch 162*c* and the second switch 162*d* generate the signal '1'. That is, the first position may be expressed as [1,1].

A second position corresponds to the case in which the first switch 162*c* contacts a region between the first groove 171*c* and the second groove 172*c* and the second switch 162*d* contacts the third groove 171*d*. At the second position, the first switch 162*c* generates the signal '0' and the second switch 162*d* generates the signal '1'. That is, the second position may be expressed as [0,1].

A third position corresponds to the case in which the first switch 162*c* contacts the second groove 172*c* and the second switch 162*d* contacts the second cam main body 172*d*. At the third position, the first switch 162*c* generates the signal '1' and the second switch 162*d* generates the signal '0'. That is, the third position may be expressed as [1,0].

A fourth position corresponds to the case in which the first switch 162*c* contacts the first cam main body 173*c* and the second switch 162*d* contacts the second cam main body 172*d*. At the fourth position, both the first switch 162*c* and the second switch 162*d* generate the signal '0'. That is, the fourth position may be expressed as [0,0].

That is, differently from the above-described embodiments, in this embodiment, pairs of signals generated at the four positions are defined so that the current direction of the nozzle 200 (with reference to FIG. 2) connected to the cams 170*c* and 170*d* may be precisely measured.

Therefore, rotation of the nozzle 200 (with reference to FIG. 2) may be controlled by disposing the cams 170*c* and 170*d* so as to allow the nozzle 200 to face a designated direction at each of the respective positions.

Although the embodiments describe the configuration and operation of the water supply apparatus as being applied the drum washing machine, the configuration and operation of the water supply apparatus may be applied to other washing machines including a pulsator washing machine.

As is apparent from the above description, a water supply apparatus in accordance with one embodiment of the present invention reduces the number of water supply hoses using a rotatable nozzle, thereby simplifying the structure of the water supply apparatus.

The water supply apparatus reduces the size of a detergent supply apparatus, thereby reducing a space within a washing machine.

The water supply apparatus using the nozzle supplies warm water and cold water to all of plural channels through a simple structure.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A water supply apparatus usable in a washing machine, which has a drum to accommodate laundry and a detergent supply apparatus including a dispenser provided with a plurality of channels to supply water to a plurality of detergents to be supplied to the drum, comprising:

at least one water supply pipe extending from the rear portion of the washing machine to the detergent supply apparatus to supply water to the dispenser;

a nozzle provided with one end connected to the at least one water supply pipe and the other end disposed adjacent to entrances of the plurality of channels, and being rotatable to supply water selectively to one of the plurality of channels;

a drive unit generating drive force to rotate the nozzle; and a rotation control device to control rotation of the drive unit, wherein the nozzle includes:

one inlet provided adjacent to the at least one water supply pipe such that water is introduced into the nozzle through the inlet; and one outlet to supply water to one of the plurality of channels, wherein the inlet has an area sufficient to cover one end of the at least one water supply pipe so as to allow water supplied from the at least one water supply pipe to be introduced into the nozzle through the inlet, and wherein the rotation control device includes:

a cam connected to the drive unit to be rotated together with the drive unit, and including at least two positioning indicators, and a switch disposed to be activated by each of the at least two positioning indicators as the nozzle is rotated, to determine a rotation position of the nozzle.

2. The water supply apparatus according to claim 1, wherein the outlet has a smaller area than the entrances of the plurality of channels to supply water to one of the plurality of channels.

3. The water supply apparatus according to claim 1, wherein the inlet has a greater area than the outlet.

4. The water supply apparatus according to claim 3, wherein:

the nozzle includes nozzle side walls forming both side surfaces of the inlet and the outlet; and the nozzle side walls are formed in a curved line from the inlet to the outlet.

5. The water supply apparatus according to claim 1, wherein the drive unit includes a motor.

6. The water supply apparatus according to claim 5, wherein the drive unit further includes a plurality of gears disposed between the motor and the nozzle to transmit drive force of the motor to the nozzle.

7. The water supply apparatus according to claim 6, wherein the plurality of gears includes:

a first gear connected to the nozzle and rotated together with the nozzle; and a second gear connected to the motor and rotated by drive force of the motor.

8. The water supply apparatus according to claim 1, wherein:

the nozzle is rotatably accommodated in the detergent supply apparatus; and the drive unit is disposed on the upper surface of the detergent supply apparatus.

9. The water supply apparatus according to claim 1, wherein the cam includes at least one protruding rib protruding in the centrifugal direction; and the switch is disposed to contact the cam, and locked with and unlocked from the at least one protruding rib to generate an ON signal and an OFF signal when the cam is rotated.

10. The water supply apparatus according to claim 1, wherein the cam includes at least one groove disposed in the radial direction; and the switch is disposed to contact the cam, and locked with and unlocked from the at least one groove to generate an ON signal and an OFF signal when the cam is rotated.

11. A water supply apparatus usable in a washing machine, which has a drum to accommodate laundry and a detergent supply apparatus to supply detergents to wash water supplied to the drum, comprising:

at least one water supply pipe extending from the rear portion of the washing machine to the detergent supply apparatus to supply water to the detergent supply apparatus; and a nozzle provided with one end connected to the at least one water supply pipe and the other end disposed to supply water to the detergent supply apparatus, and being rotatable to supply water in a designated direction within the detergent supply apparatus;

a cam connected to the nozzle to be rotated together with the nozzle, and including at least two positioning indicators; and a switch disposed to be activated by each of the at least two positioning indicators as the nozzle is rotated, to determine a rotation position of the nozzle, wherein the nozzle includes:

one inlet provided adjacent to the at least one water supply pipe such that water is introduced into the nozzle through the inlet; and one outlet to supply water to one of the plurality of channels, wherein the inlet has an area sufficient to cover one end of the at least one water supply pipe so as to allow water supplied from the at least one water supply pipe to be introduced into the nozzle through the inlet.

12. The water supply apparatus according to claim 11, wherein:

the detergent supply apparatus includes a dispenser provided with a plurality of channels to respectively supply water to a plurality of detergents; and the nozzle is rotatable to respectively supply water to the plurality of channels.

13. The water supply apparatus according to claim 12, wherein:

the detergent supply apparatus further includes a detergent case forming the external appearance of the detergent supply apparatus and accommodating the dispenser; and the nozzle is rotatably fixed within the detergent case.

14. The water supply apparatus according to claim 11, further comprising a drive unit connected to the nozzle to rotate the nozzle.

15. The water supply apparatus according to claim 14, further comprising a rotation control device to control rotation of the drive unit to stop the nozzle in a designated direction to supply water.

* * * * *